US008235056B2

(12) United States Patent
Zhuang et al.

(10) Patent No.: US 8,235,056 B2
(45) Date of Patent: Aug. 7, 2012

(54) SMOKING ARTICLE WITH CONCENTRIC HOLLOW CORE IN TOBACCO ROD AND CAPSULE CONTAINING FLAVORANT AND AEROSOL FORMING AGENTS IN THE FILTER SYSTEM

(75) Inventors: Shuzhong Zhuang, Richmond, VA (US); Georgios D. Karles, Richmond, VA (US); Raquel M. Olegario, Richmond, VA (US)

(73) Assignee: Philip Morris USA Inc., Richmond, VA (US)

( * ) Notice: Subject to any disclaimer, the term of this patent is extended or adjusted under 35 U.S.C. 154(b) by 908 days.

(21) Appl. No.: 12/000,863

(22) Filed: Dec. 18, 2007

(65) Prior Publication Data

US 2008/0163877 A1 Jul. 10, 2008

Related U.S. Application Data

(60) Provisional application No. 60/877,745, filed on Dec. 29, 2006.

(51) Int. Cl.
*A24D 3/06* (2006.01)

(52) U.S. Cl. ..... 131/337; 131/341

(58) Field of Classification Search ..... 131/337, 131/341, 335, 344

See application file for complete search history.

(56) References Cited

U.S. PATENT DOCUMENTS 2,592,553 A 4/1952 Frankenburg et al.
2,592,554 A 4/1952 Frankenburg
2,598,680 A 6/1952 Frankenburg
2,769,734 A 11/1956 Bandel
2,954,772 A 10/1960 Lebert
2,954,778 A 10/1960 Lebert
2,954,783 A 10/1960 Lebert
2,954,786 A 10/1960 Lebert
3,098,492 A 7/1963 Wurzburg et al.
3,236,244 A 2/1966 Irby, Jr. et al.
3,255,760 A 6/1966 Selke
3,283,762 A 11/1966 Kissel
3,318,312 A 5/1967 Curtis, Jr.
3,339,557 A * 9/1967 Karalus ..... 131/274

(Continued)

FOREIGN PATENT DOCUMENTS

BE 679657 A 10/1966

(Continued)

OTHER PUBLICATIONS

Written Opinion dated Aug. 5, 2004 for International Application No. PCT/US04/04530.

(Continued)

*Primary Examiner* — Richard Crispino
*Assistant Examiner* — Dionne Walls Mayes
(74) *Attorney, Agent, or Firm* — Buchanan Ingersoll & Rooney PC

(57) ABSTRACT

A smoking article having a cylinder of smoking material and a central tube within the cylinder of the smoking material wherein heat is convectively transferred with smoke from a lit end of the cylinder of smoking material through the central tube to a mouth end of the cylinder of smoking material in each puff. A filter system is attached to the cylinder of smoking material, and includes a plurality of segments, wherein at least one of the plurality of segments contains flavorant and aerosol forming agents encapsulated in at least one breakable capsule.

13 Claims, 1 Drawing Sheet

U.S. PATENT DOCUMENTS

| | | | | |
|---|---|---|---|---|
| 3,356,094 | A | 12/1967 | Ellis et al. | |
| 3,395,713 | A | 8/1968 | Ent-Keller | |
| 3,428,049 | A * | 2/1969 | Leake et al. | 131/337 |
| 3,457,927 | A | 7/1969 | Siragusa | |
| 3,496,945 | A | 2/1970 | Tomkin | |
| 3,581,748 | A | 6/1971 | Cameron | |
| 3,637,447 | A | 1/1972 | Berger et al. | |
| 3,648,712 | A | 3/1972 | Patterson | |
| 3,685,522 | A | 8/1972 | Kleinhans | |
| 3,738,375 | A | 6/1973 | Doumas | |
| 3,756,249 | A | 9/1973 | Selke et al. | |
| 3,759,270 | A | 9/1973 | Wright | |
| 3,860,011 | A | 1/1975 | Norman | |
| 3,931,824 | A | 1/1976 | Miano et al. | |
| 3,968,804 | A | 7/1976 | Kelly et al. | |
| 3,986,515 | A | 10/1976 | Egri | |
| 4,016,887 | A | 4/1977 | Uroshevich | |
| 4,022,222 | A | 5/1977 | Berger | |
| 4,091,821 | A | 5/1978 | Scorzo | |
| 4,119,105 | A | 10/1978 | Owens, Jr. | |
| 4,120,310 | A | 10/1978 | Lee et al. | |
| 4,135,523 | A | 1/1979 | Luke et al. | |
| 4,182,349 | A | 1/1980 | Selke | |
| 4,186,756 | A | 2/1980 | Takemoto et al. | |
| 4,197,863 | A | 4/1980 | Clayton et al. | |
| 4,256,122 | A | 3/1981 | Johnson | |
| 4,256,126 | A | 3/1981 | Seligman et al. | |
| 4,273,141 | A | 6/1981 | Jan Van Tilburg | |
| 4,292,983 | A | 10/1981 | Mensik | |
| 4,340,072 | A | 7/1982 | Bolt et al. | |
| 4,341,228 | A | 7/1982 | Keritsis et al. | |
| 4,357,950 | A | 11/1982 | Berger | |
| 4,380,241 | A | 4/1983 | Horsewell | |
| 4,386,618 | A | 6/1983 | Cantrell | |
| 4,421,126 | A | 12/1983 | Gellatly | |
| 4,460,001 | A | 7/1984 | Browne et al. | |
| 4,469,112 | A | 9/1984 | Browne et al. | |
| 4,508,525 | A | 4/1985 | Berger | |
| 4,515,170 | A | 5/1985 | Cantrell et al. | |
| 4,542,755 | A | 9/1985 | Selke et al. | |
| 4,564,030 | A | 1/1986 | Jessup et al. | |
| 4,574,820 | A | 3/1986 | Pinkerton et al. | |
| 4,585,015 | A | 4/1986 | Silberstein | |
| 4,622,982 | A | 11/1986 | Gaisch et al. | |
| 4,637,409 | A | 1/1987 | Berger | |
| 4,649,944 | A | 3/1987 | Houck, Jr. et al. | |
| 4,660,579 | A | 4/1987 | Horsewell et al. | |
| 4,677,992 | A | 7/1987 | Bliznak | |
| 4,687,008 | A | 8/1987 | Houck, Jr. et al. | |
| 4,700,726 | A | 10/1987 | Townsend et al. | |
| 4,732,168 | A | 3/1988 | Resce et al. | |
| 4,754,766 | A | 7/1988 | Luke et al. | |
| 4,784,632 | A | 11/1988 | Berger | |
| 4,793,365 | A | 12/1988 | Sensabaugh et al. | |
| 4,867,182 | A | 9/1989 | Roberts et al. | |
| 4,896,682 | A | 1/1990 | Liew | |
| 4,924,886 | A | 5/1990 | Litzinger | |
| 4,942,887 | A | 7/1990 | Abdelgawad et al. | |
| 4,962,774 | A | 10/1990 | Thomasson et al. | |
| 4,972,853 | A | 11/1990 | Brackmann et al. | |
| 4,972,854 | A | 11/1990 | Kiernan et al. | |
| 4,984,588 | A | 1/1991 | Stewart, Jr. | |
| 5,046,514 | A | 9/1991 | Bolt | |
| 5,050,621 | A | 9/1991 | Creighton et al. | |
| 5,058,608 | A | 10/1991 | Henning et al. | |
| 5,060,676 | A | 10/1991 | Hearn et al. | |
| 5,074,319 | A | 12/1991 | White et al. | |
| 5,099,864 | A | 3/1992 | Young et al. | |
| 5,101,839 | A | 4/1992 | Jakob et al. | |
| 5,105,836 | A | 4/1992 | Gentry et al. | |
| 5,105,838 | A | 4/1992 | White et al. | |
| 5,129,408 | A | 7/1992 | Jakob et al. | |
| 5,178,166 | A | 1/1993 | Newsome et al. | |
| 5,190,061 | A | 3/1993 | Brackmann et al. | |
| 5,203,354 | A | 4/1993 | Hickle | |
| 5,360,023 | A | 11/1994 | Blakley et al. | |
| 5,392,792 | A | 2/1995 | Banerjee et al. | |
| 5,392,793 | A | 2/1995 | Molloy | |
| 5,435,326 | A | 7/1995 | Gentry et al. | |
| 5,458,107 | A | 10/1995 | Balogh et al. | |
| 5,524,647 | A | 6/1996 | Brackmann | |
| 5,533,530 | A | 7/1996 | Young et al. | |
| 5,568,819 | A | 10/1996 | Gentry et al. | |
| 5,584,306 | A | 12/1996 | Beauman et al. | |
| 5,598,868 | A | 2/1997 | Jakob et al. | |
| 5,666,976 | A | 9/1997 | Adams et al. | |
| 5,690,127 | A | 11/1997 | Chapman et al. | |
| 5,709,227 | A | 1/1998 | Arzonico et al. | |
| 5,715,844 | A | 2/1998 | Young et al. | |
| 5,724,998 | A | 3/1998 | Gellatly et al. | |
| 5,727,571 | A | 3/1998 | Meiring et al. | |
| 5,743,251 | A | 4/1998 | Howell et al. | |
| 5,746,230 | A | 5/1998 | Arterbery et al. | |
| 5,839,449 | A | 11/1998 | Banerjee et al. | |
| 5,954,061 | A | 9/1999 | Cardarelli | |
| 6,089,238 | A | 7/2000 | Schneider et al. | |
| 6,216,706 | B1 | 4/2001 | Kumar et al. | |
| 6,257,242 | B1 | 7/2001 | Stavridis | |
| 6,584,979 | B2 * | 7/2003 | Xue et al. | 131/344 |
| 6,718,989 | B1 | 4/2004 | Clarke et al. | |
| 6,761,174 | B2 | 7/2004 | Jupe et al. | |
| 6,779,529 | B2 | 8/2004 | Figlar et al. | |
| 6,814,786 | B1 | 11/2004 | Zhuang et al. | |
| 6,823,873 | B2 | 11/2004 | Nichols et al. | |
| 6,883,516 | B2 | 4/2005 | Hindle et al. | |
| 6,883,523 | B2 | 4/2005 | Dante | |
| 2002/0166561 | A1 | 11/2002 | Sinclair, Jr. | |
| 2003/0200973 | A1 | 10/2003 | Xue et al. | |
| 2003/0200976 | A1 | 10/2003 | Yoo | |
| 2004/0025890 | A1 | 2/2004 | Yen | |
| 2004/0159327 | A1 | 8/2004 | Dante | |
| 2004/0261807 | A1 | 12/2004 | Dube et al. | |
| 2005/0066980 | A1 * | 3/2005 | Crooks et al. | 131/341 |
| 2005/0066981 | A1 | 3/2005 | Crooks et al. | |
| 2006/0201524 | A1 | 9/2006 | Zhang et al. | |
| 2007/0169785 | A1 | 7/2007 | Gedevanishvili et al. | |
| 2007/0181140 | A1 | 8/2007 | Xue et al. | |
| 2007/0186945 | A1 | 8/2007 | Olegario et al. | |
| 2007/0235050 | A1 | 10/2007 | Li et al. | |
| 2007/0261706 | A1 | 11/2007 | Banerjea et al. | |
| 2008/0017204 | A1 | 1/2008 | Braunshteyn et al. | |
| 2008/0047571 | A1 | 2/2008 | Braunshteyn et al. | |
| 2008/0216848 | A1 | 9/2008 | Li et al. | |
| 2008/0216851 | A1 | 9/2008 | Olegario et al. | |

FOREIGN PATENT DOCUMENTS

| | | | |
|---|---|---|---|
| BE | 1000454 | A4 | 12/1988 |
| DE | 3439861 | A1 | 5/1985 |
| EP | 0077123 | A2 | 4/1983 |
| EP | 0212879 | A1 | 3/1987 |
| EP | 0364256 | A1 | 4/1990 |
| EP | 0471 581 | A1 | 2/1992 |
| EP | 0482 872 | A1 | 4/1992 |
| EP | 0568107 | A | 11/1993 |
| EP | 0481596 | B1 | 1/1994 |
| FR | 2481581 | | 11/1981 |
| GB | 1058342 | A | 2/1967 |
| GB | 1228747 | | 4/1971 |
| GB | 1256154 | | 12/1971 |
| GB | 1428018 | | 3/1976 |
| GB | 2100573 | A | 1/1983 |
| GB | 2149287 | A | 6/1985 |
| GB | 2177890 | A | 2/1987 |
| WO | WO 90/09741 | A | 9/1990 |
| WO | WO 99/26495 | A | 6/1999 |
| WO | WO00/00047 | | 1/2000 |
| WO | WO 02/03819 | A | 1/2002 |
| WO | WO 2006/070289 | A | 7/2006 |
| WO | WO2006082529 | A | 8/2006 |
| WO | WO2007/093757 | A1 | 8/2007 |
| WO | WO2007/110650 | A1 | 10/2007 |

OTHER PUBLICATIONS

International Search Report dated Aug. 5, 2004 for PCT/US04/04530.

International Search Report dated Oct. 19, 2007 for International Application No. PCT/IB2006/004202.
Written Opinion dated Oct. 19, 2007for International Application No. PCT/IB2006/004202.
Invitation to Pay Additional Fees and Annex to Form PCT/ISA/206 Communication Relating to the Results of the Partial International Search dated Oct. 16, 2007 for International Application No. PCT/IB2006/004209.
International Preliminary Report on Patentability mailed Jul. 9, 2009 for PCT/IB2007/004503.
International Preliminary Report on Patentability dated Jul. 10, 2008 for PCT/IB2006/004202.
International Preliminary Report on Patentability dated Jul. 10, 2008 for PCT/IB2006/004209.
International Search Report and Written Opinion dated Sep. 19, 2008 for PCT/IB2007/004503.
International Search Report and Written Opinion dated Mar. 17, 2008 for PCT/IB2006/004209.
International Preliminary Report on Patentability mailed Sep. 24, 2009 for International Application No. PCT/IB2008/001372.
International Search Report and Written Opinion dated Nov. 3, 2008 for PCT/IB2008/001372.
International Preliminary Report on Patentability for PCT/IB2007/004224 dated May 19, 2009.
International Preliminary Report on Patentability for PCT/GB2007/001144 dated Sep. 30, 2008.
International Search Report and Written Opinion for PCT/IB2007/004224 dated Jun. 13, 2008.
International Search Report and Written Opinion for PCT/GB2007/00114 dated Jul. 7, 2007.
International Preliminary Report on Patentability mailed Sep. 15, 2009 for PCT/IB2008/001383.
International Search Report and Written Opinion mailed Feb. 24, 2009 for PCT/IB2008/001383.
Partial International Search Report mailed Nov. 11, 2008 for PCT/IB2008/001383.
International Preliminary Report on Patentability issued Jan. 13, 2009 for PCT/IB2007/002869.
International Search Report and Written Opinion dated Jan. 25, 2008 for PCT/IB2007/002869.
International Preliminary Report on Patentability issued Jan. 13, 2009 for PCT/IB2007/002910.

* cited by examiner

SMOKING ARTICLE WITH CONCENTRIC HOLLOW CORE IN TOBACCO ROD AND CAPSULE CONTAINING FLAVORANT AND AEROSOL FORMING AGENTS IN THE FILTER SYSTEM

CROSS REFERENCE TO RELATED APPLICATION

This application claims priority under 35 U.S.C. §119(e) to U.S. provisional Application No. 60/877,745, filed on Dec. 29, 2006, the entire content of which is incorporated herein by reference.

BACKGROUND

Smoking articles, particularly cigarettes, generally comprise a tobacco rod of shredded tobacco (usually, in cut filler form) surrounded by a paper wrapper, and a cylindrical filter aligned in an end-to-end relationship with the tobacco rod. The tobacco rod is generally between 6.0 and 10.0 millimeters in diameter and 60 millimeters and 125 millimeters in length. Typically, the filter includes a plug of cellulose acetate tow attached to the tobacco rod by tipping paper. Ventilation of mainstream smoke can be achieved with a row or rows of perforations about a location along the filter.

Flavorant and aerosol forming agents can be added to cigarettes and smoking articles to provide a pleasurable sensory experience. Some smokers may prefer a cigarette that is capable of selectively providing a variety of different flavors, depending upon the smoker's immediate desire, either in the short term or in the long term. However, certain flavorants (and aerosol forming agents) are volatile and have the propensity to evaporate or migrate over time, which lessens the effects of those flavorants. Accordingly, it is desirable to provide a cigarette that enhances the transfer of flavor and aerosols, and minimizes the migration of flavor and aerosol forming agents.

SUMMARY

In accordance with one embodiment, a smoking article comprises: a cylinder of smoking material; a central tube within the cylinder of the smoking material, wherein heat is convectively transferred with smoke from a lit end of the cylinder of smoking material through the central tube to a mouth end of the cylinder of smoking material in each puff; and a filter system attached to the cylinder of smoking material. The filtering system comprises a plurality of segments. At least one of the plurality of segments contains flavorant and aerosol forming agents encapsulated in at least one breakable capsule.

In accordance with another embodiment, a smoking article comprises: a cylinder of smoking material; a central tube within the cylinder of the smoking material, wherein heat is convectively transferred with smoke from a lit end of the cylinder of smoking material through the central tube to a mouth end of the cylinder of smoking material in each puff; and a filter system connected to the cylinder of smoking material. The filtering system comprises a plurality of segments. At least one of the plurality of segments contains flavorant and aerosol forming agents encapsulated in at least one breakable capsule, an adsorbent material and a filtering material wherein the capsule is upstream of the adsorbent material.

In accordance with a further embodiment, a method of making a smoking article comprises the steps of: forming a tobacco rod portion of the smoking article by placing tobacco filler material between a tube and an outer layer of wrapper paper; forming a filter system having a plurality of segments with at least one of said segments containing flavorant and aerosol forming agents encapsulated in a breakable capsule; and joining the tobacco rod portion in end-to-end relationship with said filter system.

DETAILED DESCRIPTION

Figure 1:
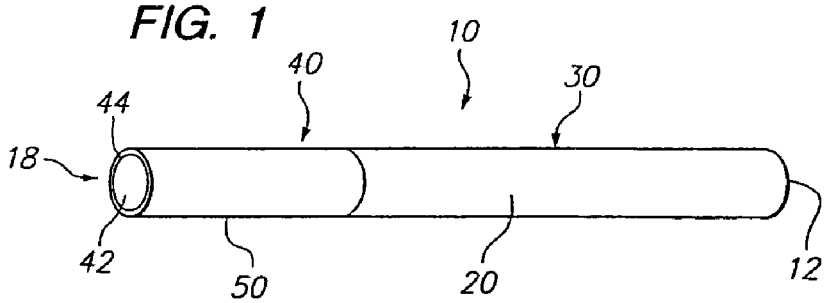
FIG. 1 shows a perspective view of a smoking article having a hollow core and a filter system.

FIG. 1 shows a perspective view of a smoking article 10 in the form of a cigarette having a hollow core and a filter system containing a breakable capsule of flavorant and aerosol forming agents. Smoking articles 10 in the form of cigarettes typically include a generally cylindrical rod 20 of smoking material 21 (shown in FIG. 2), contained in a circumscribing outer wrapper 30. The outer wrapper 30 is typically a porous wrapping material or paper wrapper. The rod 20 is typically referred to as a "tobacco rod" and has a lit end 12 and a mouth end 14 (shown in FIG. 2). As such, the tobacco rod 20 burns back from the lit end 12 thereof towards the opposite end (i.e., mouth end 14) thereof, and the smoking material 21 of the tobacco rod 20 is consumed by combustion during the smoking period. The smoking material 21 is preferably a shredded tobacco or tobacco cut filler. However, any suitable smoking material 21 can be used.

Herein, the "upstream" and "downstream" relative positions between filter segments and other features are described in relation to the direction of mainstream smoke as it is drawn from the tobacco rod 20 and through the multi-component filter system 40.

The smoking article 10 also includes a filter system 40 adjacent to the mouth end 14 of the tobacco rod 20 such that the filter system 40 and tobacco rod 20 are axially aligned in an end-to-end relationship, preferably abutting one another. The filter system 40 has a generally cylindrical shape, and the diameter thereof is essentially equal to the diameter of the tobacco rod 20. The ends (i.e., upstream end 16 (shown in FIG. 2) and downstream end 18) of the filter system 40 are open to permit the passage of air and smoke therethrough.

The filter system 40 includes a plurality of filter segments 42 circumscribed by a plug wrap 44. The plug wrap 44 is a paper which optionally incorporates a carbonaceous material. The plug wrap 44 circumscribes the total length of the filter system 40. The filter system 40 is attached to the tobacco rod 20 by a tipping material 50, which circumscribes both the entire length of the filter system 40 and an adjacent region of the tobacco rod 20. The tipping material 50 is typically a paper like product; however, any suitable material can be used. The inner surface of the tipping material 50 is fixedly secured to the outer surface of the plug wrap 44 and the outer surface of the wrapping material 30 of the tobacco rod 20, using a suitable adhesive. A ventilated or air diluted smoking article can be provided with an air dilution means, such as a series of ventilation holes or perforations (not shown), each of which extend through the tipping material 50 and optionally the plug wrap 44.

Figure 2:
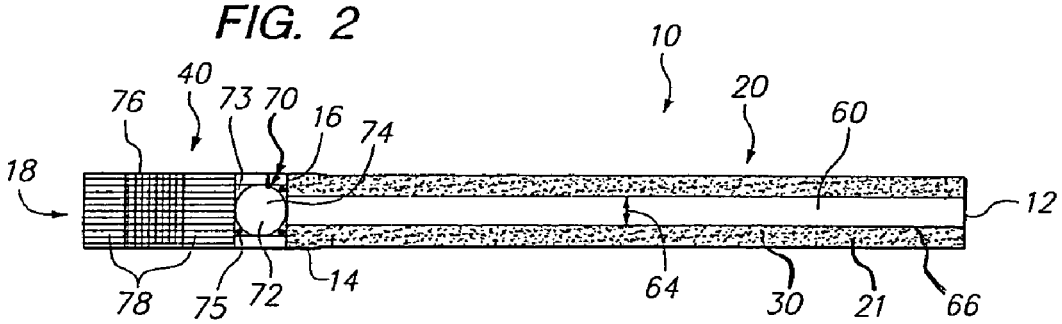
FIG. 2 shows a longitudinal cross sectional view of the smoking article of FIG. 1 with a hollow core and a capsule containing flavorant and aerosol forming agents in the filter system.

FIG. 2 shows the smoking article 10 of FIG. 1 in the form of a cigarette having a concentric hollow core or tube 60 and a filter system 40. The filter includes a capsule 70 containing flavorant 72 and aerosol forming agents 74. As shown in FIG. 2, the tobacco rod 20 is comprised of a smoking material 21, a central hollow tube 60, which is surrounded by tobacco filler material 21, and an outer layer of cigarette wrapper (paper) 30. The central tube 60 within the cylinder of smoking material 21 preferably extends all the way to the mouth end 14 of the tobacco rod 20 and abuts the upstream end 16 of the filter system 40. The central hollow tube 60 preferably has an inner diameter 64 of about 1 to 3.5 millimeters and more preferably about 2 to 3 millimeters.

The walls 66 of the hollow tube 60 can be made of cellulose-based paper, tobacco-based paper and/or suitable combustible film. Alternatively, the hollow core tube 60 can be molded, extruded or formed by combustible materials, such as blended tobacco and/or cellulose-based materials using suitable binders such as pectin, guar gum, hydroxy propyl cellulose (HPC), and hydroxy propyl methyl cellulose (HPMC). In addition, it can be appreciated that the hollow tube 60 can have a fully filled tip 62 (shown in FIG. 3) of approximately 5 millimeters of smoking material 21 to assist with the lighting of the smoking article 10.

As shown in FIG. 2, the smoking article 10 comprises a cylindrical tobacco rod 20 of smoking material 21, such as shredded tobacco having a central tube 60 therein, and a multi-component filter system 40 attached to the tobacco rod 20 with a tipping paper 50 (shown in FIG. 1). Upon lighting of the smoking article 10, mainstream smoke is generated by and drawn from the tobacco rod 20 and through the filter system 40.

The filter system 40 preferably comprises a plurality of filter segments 42 (shown in FIG. 1) including a first, upstream capsule 70 containing a liquid 71 (shown in FIG. 4) including at least one flavorant 72 and aerosol forming agents 74. The liquid 71 is preferably a solution or emulsion contained within the capsule 70. The capsule 70 is preferably made of a breakable material, such that upon squeezing of the filter system 40, the capsule 70 breaks or ruptures releasing the liquid 71 containing the flavorant 72 and aerosol forming agents 74. The aerosol forming agents 74 contained within the capsule 70 are preferably hydrophobic in nature. However, the aerosol forming agents 74 can also include propylene glycol, glycerin, propylene carbonate, triacetin, or other suitable materials. It can be appreciated that since the flavorant 72 and aerosol forming agents 74 are enclosed by a sealed capsule 70, their migration, and therefore the deactivation of the porous adsorbents 76 can be minimized. Although, a single capsule 70 is shown, it can be appreciated that in an alternative embodiment, more than one capsule 70 can be positioned within the filter system 40. For example, rather than a single capsule 70, FIG. 3 shows a plurality of capsules 70 positioned within a cavity 73 of the filter system 40.

The capsule 70 diameter can vary from about 200 microns to about 6.0 millimeters, with microcapsules ranging in size from about 200 to 750 microns in diameter. In an embodiment having a single capsule 70, the capsule 70 preferably has an outer diameter of about 2 to 5 millimeters and more preferably about 3 to 4 millimeters. If a plurality of capsules 70 are used, the capsules 70 preferably have an outer diameter of about 250 microns to 2 millimeters and more preferably about 500 microns. The outer diameter of the capsules 70, however, can vary depending on the diameter of the smoking article 10 and the number of capsules 70 within the filter system 40.

Figure 3:
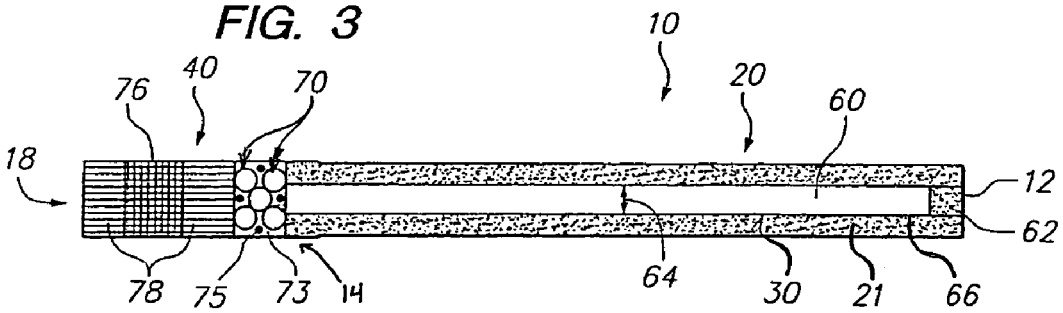
FIG. 3 shows a cross sectional view of an alternative embodiment of the smoking article of FIG. 2 with a hollow core and capsules containing flavorant and aerosol forming agents in the filter system.
Figure 4:
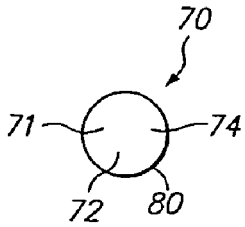
FIG. 4 shows a capsule for use with a smoking article, wherein the capsule contains flavorant and aerosol forming agents.

An adsorbent material 76 is preferably downstream of the capsule 70 as shown in FIGS. 2 and 3. However, it can be appreciated that the adsorbent material 76 can be upstream of the capsule 70 containing the flavorant 72 and aerosol forming agents 74 as shown in FIG. 4. The adsorbent material 76 preferably consists of porous materials including activated carbons, zeolites, silica gels or polymer based adsorbents. As shown in FIG. 2, the adsorbent material 76 is preferably between an upstream and a downstream segment or plug of filtering material 78. The filtering material 78 is preferably cellulose acetate tow having a low resistance to draw ("RTD"). However, any suitable filtering material 78 can be used.

Before smoking, the smoker squeezes and breaks the capsule 70 releasing the liquid 71 including the flavorants 72 and aerosol forming agents 74. In an embodiment, as shown in FIGS. 2-3, an inert hard material 75 can be added to the cavity 73. As shown in FIGS. 2 and 3, the inert hard material 75 is preferably intermixed within the cavity 73 containing the capsules 70 and provides a hard surface to assist with the breaking or rupturing of the capsule 70.

During smoking, heat is convectively transferred with the cigarette smoke from the lit end 12 through the hollow core or tube 60 to the mouth end 14 of the tobacco rod 20 in each puff. The flavorant 72 and aerosol forming agents 74 are vaporized by the heat and form aerosols. It can be appreciated that the release of aerosols can also be achieved by thermally dissolving or melting the outer shell 80 of the capsule 70.

It can be appreciated that in one embodiment of the smoking article 10, with a hollow core or tube 60, a limited amount of heat can be transferred to the mouth end 14 of the tobacco rod 20 during each puff. Accordingly, the flavorant 72 and aerosol forming agents 74 preferably have a relatively high volatility and high vapor pressure in the filter system 40 in order to produce an effective quantity of aerosols. In addition, the composition of the total particulate matter (TPM) can be altered by introducing the inert aerosols to the mainstream smoke. It can be appreciated that by encapsulating the flavorant 72 and aerosol forming agents 74, the smoking article 10 reduces occurrences of spotting on the surface of the smoking article 10 and deactivation of the adsorbent materials 76 during ageing. Furthermore, since the volatile flavorant 72 and aerosol forming agents 74 are encapsulated migration of the flavorant 72 and aerosol forming agents 74 is minimized during shelf life.

FIG. 3 shows a further embodiment of the smoking article of FIG. 2 having a concentric hollow core or tube 60 and a plurality of capsules 70 containing flavorant 72 and aerosol forming agents 74. As shown in FIG. 3, a plurality of capsules 70 containing flavorant 72 and aerosol forming agents 74 are positioned upstream of the adsorbent material 76. A plug of filtering material 78 is positioned on each side of the adsorbent material 76. The plurality of capsules 70 can contain similar flavorant 72 and aerosol forming agents 74 or different flavorant 72 and aerosol forming agents 74. For example, it may be desired to prevent flavorant 72 and aerosol forming agents 74 from combining until the capsules 70 are ruptured or broken by the smoker due to the composition of each.

In addition, as shown in FIG. 3, the lit end 12 of the central tube 60 of the tobacco rod 20 can be filled with a smoking material 21, which will be enough for at least the first puff. It can be appreciated to allow easy lighting of the smoking article 10, the hollow tube 60 can have a fully filled tip 62 of approximately 5 millimeters of smoking material 21. Around the above-mentioned smoking material 21, a filler loose tobacco or other suitable material can be placed to maintain visual integrity of the smoking article 10. During the first puff, the smoke from the burned filler goes through the hollow tube 60 to the filter system 40.

FIG. 4 shows a capsule 70 comprising a flavorant 72 and aerosol forming agents encapsulated in an outer shell 80. The composition of the outer shell 80 of the capsule 70 can be a polysaccharide based material such as pectin and alginate, gelatin, a paraffin wax, a polyvinyl alcohol, a mixture of vinyl acetate and algin, or any other suitable material. It can be appreciated that a multitude of processes exist for manufacturing the capsules 70. Accordingly, the capsules 70 can include varying size and shape, differing resistance to kinetic forces required to break or rupture the capsule 70, and can include alternative capsule 70 compositions and capsule 70 constituents. In addition, the break or rupture force can vary from about 15 grams to about 2500 grams and most preferably from about 800 to 1200 grams depending on the composition of the outer shell 80. The capsules 70 contain the flavorant 72, which can be an aroma of choice, such as peppermint, coconut, roasted, and/or toasted aromas or any flavor oil or composition that can be encapsulated. In addition, the concentration of flavorant 72 within each capsule can be adjusted or modified to provide the desired amount of flavorant 72. Thus, the concentration of the flavorant 72, within each capsule 70 can be the same or can vary depending on the desired aroma.

It will be understood that the foregoing description is of the preferred embodiments, and is, therefore, merely representative of the article and methods of manufacturing the same. It can be appreciated that many variations and modifications of the different embodiments in light of the above teachings will be readily apparent to those skilled in the art. Accordingly, the exemplary embodiments, as well as alternative embodiments, may be made without departing from the spirit and scope of the articles and methods as set forth in the attached claims.

What is claimed is:

1. A smoking article comprising:

a cylinder of smoking material;

a central tube within the cylinder of the smoking material, wherein heat is convectively transferred with smoke from a lit end of the cylinder of smoking material through the central tube to a mouth end of the cylinder of smoking material in each puff; and a filter system attached to the cylinder of smoking material, the filtering system comprising a flavorant and aerosol forming agents encapsulated in at least one breakable capsule on an upstream side of a plug of filtering material, a plug of adsorbent material and a second plug of filtering material, and wherein the at least one breakable capsule is intermixed within a cavity with an inert hard material, which provides a hard surface to assist with breaking and/or rupturing the at least one breakable capsule.

2. The smoking article of claim 1, wherein the flavorant and aerosol agents are vaporized by heat from the smoking material and form aerosols.

3. The smoking article of claim 1, wherein the at least one capsule ruptures upon an application of manual force releasing the flavorant and the aerosol forming agents.

4. The smoking article of claim 1, wherein the tube extends to a juncture of the filter system.

5. The smoking article of claim 1, wherein the first and second plugs of filtering material are cellulose acetate tow.

6. The smoking article of claim 1, wherein the at least one breakable capsule comprises a plurality of breakable capsules.

7. The smoking article of claim 1, further comprising a plug of smoking material within the tube at the lit end of the cylinder of smoking material.

8. The smoking article of claim 1, wherein the at least one breakable capsule comprises multiple breakable capsules, each capsule including the same flavorant and aerosol forming agents.

9. The smoking article of claim 1, wherein the at least one breakable capsule comprises multiple breakable capsules, each capsule including different flavorant and/or aerosol forming agents.

10. A smoking article comprising:

a cylinder of smoking material;

a central tube within the cylinder of the smoking material, wherein heat is convectively transferred with smoke from a lit end of the cylinder of smoking material through the central tube to a mouth end of the cylinder of smoking material in each puff; and a filter system connected to the cylinder of smoking material, the filtering system comprising a plurality of segments, wherein at least one of the plurality of segments contains flavorant and aerosol forming agents encapsulated in at least one breakable capsule, an adsorbent material and a filtering material, wherein the breakable capsule is upstream of the adsorbent material, and wherein the at least one breakable capsule is intermixed within a cavity with an inert hard material, which provides a hard surface to assist with breaking and/or rupturing the at least one breakable capsule.

11. The smoking article of claim 10, wherein the flavorant and aerosol agents are vaporized by heat from the smoking material and form aerosols.

12. The smoking article of claim 10, wherein the filtering material is a cellulose acetate tow.

13. A method of making a smoking article, comprising:

forming a tobacco rod portion of the smoking article by placing tobacco filler material between a tube and an outer layer of wrapper paper; and joining said tobacco rod portion in end-to-end relationship with a filter system, the filter system having a plurality of segments with at least one of said segments containing flavorant and aerosol forming agents encapsulated in at least one breakable capsule, and at least one segment of an adsorbent material, wherein the adsorbent material is between an upstream and a downstream segment of cellulose acetate, and the at least one breakable capsule is upstream of the at least one segment of an adsorbent material, and wherein the at least one breakable capsule is intermixed within a cavity with an inert hard material, which provides a hard surface to assist with breaking and/or rupturing the at least one breakable capsule.

* * * * *